US008538281B2

(12) United States Patent
Takuwa et al.

(10) Patent No.: US 8,538,281 B2
(45) Date of Patent: Sep. 17, 2013

(54) IMAGE FORMING APPARATUS AND IMAGE FORMING METHOD

(75) Inventors: Noriyuki Takuwa, Kanagawa-ken (JP); Hirofumi Hiyoshi, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 272 days.

(21) Appl. No.: 13/091,094

(22) Filed: Apr. 20, 2011

(65) Prior Publication Data

US 2011/0262186 A1 Oct. 27, 2011

Related U.S. Application Data

(60) Provisional application No. 61/326,598, filed on Apr. 21, 2010, provisional application No. 61/326,605, filed on Apr. 21, 2010.

(51) Int. Cl.
*G03G 15/08* (2006.01)

(52) U.S. Cl.
USPC ..... 399/27; 399/359

(58) Field of Classification Search
USPC ..... 399/358, 359, 27, 149
See application file for complete search history.

(56) References Cited

U.S. PATENT DOCUMENTS

| | | | | |
|---|---|---|---|---|
| 7,313,336 | B2 * | 12/2007 | Kadota et al. | 399/49 |
| 7,366,457 | B2 | 4/2008 | Ono | |
| 8,131,178 | B2 * | 3/2012 | Swantner et al. | 399/101 |

FOREIGN PATENT DOCUMENTS

| | | | |
|---|---|---|---|
| JP | 62-154463 | | 9/1987 |
| JP | 09-179394 | | 7/1997 |
| JP | 2000-035703 | | 2/2000 |
| JP | 2000035703 | A * | 2/2000 |
| JP | 2008-170510 | | 7/2008 |
| JP | 2012123211 | A * | 6/2012 |

* cited by examiner

*Primary Examiner* — David Gray
*Assistant Examiner* — Carla Therrien
(74) *Attorney, Agent, or Firm* — Patterson & Sheridan, LLP

(57) ABSTRACT

An image forming apparatus includes: an image carrier transferring the developer image to a material at a transfer position; plural developing units supplying developer of corresponding colors; a cleaner disposed downstream of the transfer position in the rotating direction of the image carrier with respect to the image carrier; a recycle developer storage unit storing the developer; a recycle developer developing unit supplying the developer to the image carrier; and a control unit controlling a recycle developer adjustment by supplying the developer from at least one of the plural developing units to the image carrier, forming a developer image on the image carrier, allowing the developer image to pass through the transfer position without being transferred onto the material, and allowing the developer of the developer image to be recovered in the cleaner to supply the developer to the recycle developer storage unit.

20 Claims, 13 Drawing Sheets

IMAGE FORMING APPARATUS AND IMAGE FORMING METHOD

CROSS-REFERENCE TO RELATED APPLICATION

This application is based upon and claims the benefit of priority from: U.S. provisional application 61/326,598, filed on Apr. 21, 2010; and U.S. provisional application 61/326,605, filed on Apr. 21, 2010; the entire contents all of which are incorporated herein by reference.

FIELD

This specification relates to an image forming apparatus that recovers a toner that was not transferred onto a sheet, and forms a toner image with the use of the recovered toner.

BACKGROUND

Up to now, in an image forming apparatus such as an MFP (multi-function peripheral), a toner image is formed on a surface of an image carrier such as a surface of a photosensitive body or a surface of an intermediate transfer belt. The toner image formed on the surface of the photosensitive body is transferred onto a sheet or the intermediate transfer belt. The toner image transferred onto the intermediate transfer belt is transferred onto the sheet.

The toner image formed on the surface of the image carrier is transferred onto a material to be transferred, but a part of toner remains on the surface of the image carrier. The remaining toner is removed by a cleaner disposed in the photosensitive body or the intermediate transfer belt, and is recovered as a waste toner.

Also, in the image forming apparatus that enables color image formation, the residual toner in which the colors are mixed together, formed on the photosensitive bodies corresponding to the respective colors, or the intermediate transfer belt, is recovered as the waste toner.

The waste toner thus recovered is normally temporarily stored in a waste toner recovery container within the image forming apparatus, and discarded.

DETAILED DESCRIPTION

An embodiment includes an image carrier, a plurality of developing units, a cleaner, a recycle developer storage unit, a recycle developer developing unit, and a control unit.

The image carrier has a developer image formed thereon, and transfers the formed developer image to a material to be transferred at a transfer position. The plurality of developing units supplies developer of corresponding colors to the image carrier. The cleaner is disposed downstream of the transfer position in the rotating direction of the image carrier with respect to the image carrier, removes the developer remaining on the surface of the image carrier, and recovers the removed developer. The recycle developer storage unit stores the developer recovered by the cleaner therein. The recycle developer developing unit supplies the developer stored in the recycle developer storage unit to the image carrier. The control unit controls a recycle developer adjustment, which supplies the developer from at least anyone of the plurality of developing units to the image carrier, forms a developer image on the image carrier, allows the developer image to pass through the transfer position without being transferred onto the material to be transferred, and allows the developer of the developer image to be recovered in the cleaner to supply the developer to the recycle developer storage unit.

First Embodiment

A first embodiment will be described below with reference to the accompanying drawings.

Figure 1:
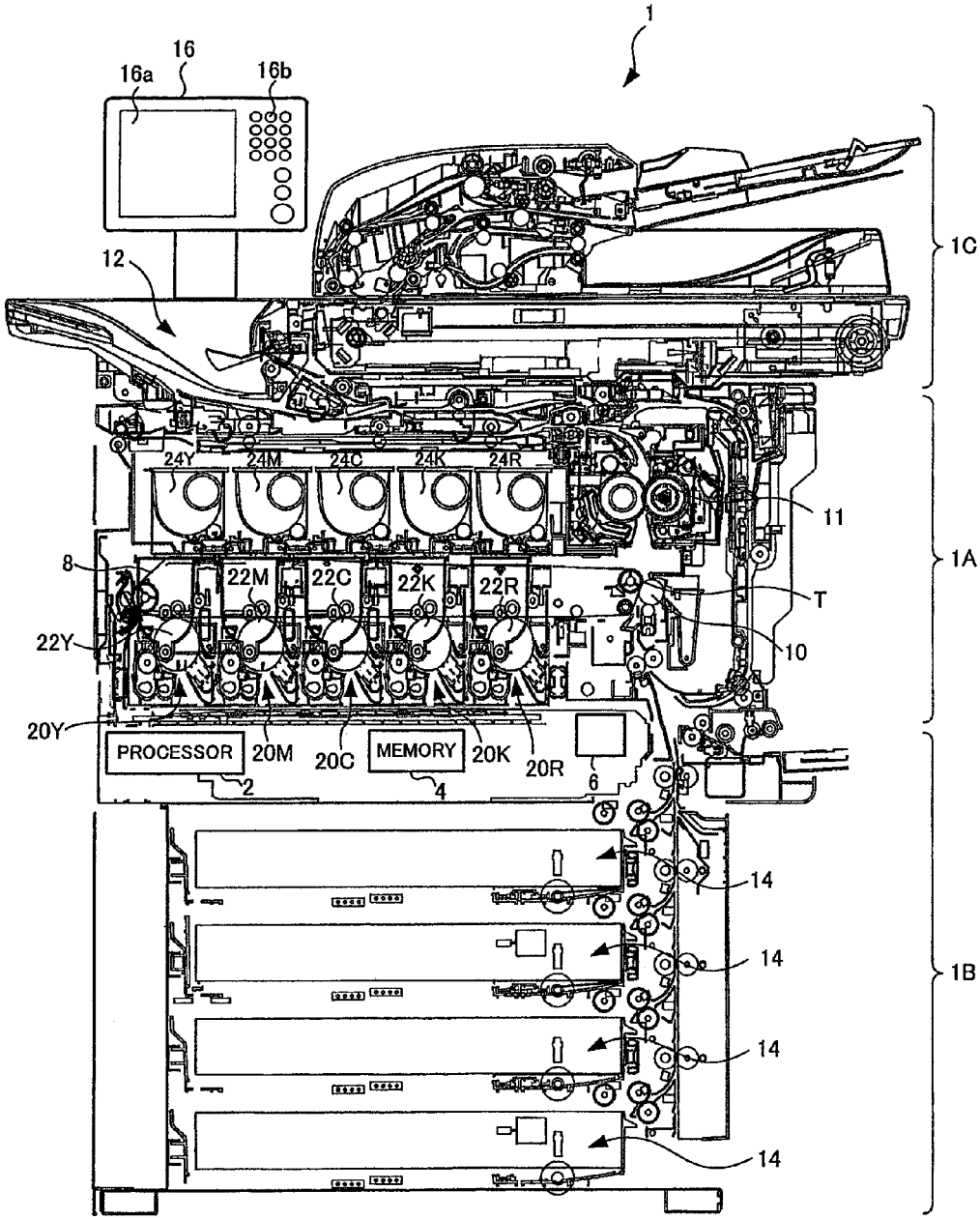
FIG. 1 is a configuration diagram illustrating a configuration of an image forming apparatus according to one embodiment.
Figure 2:
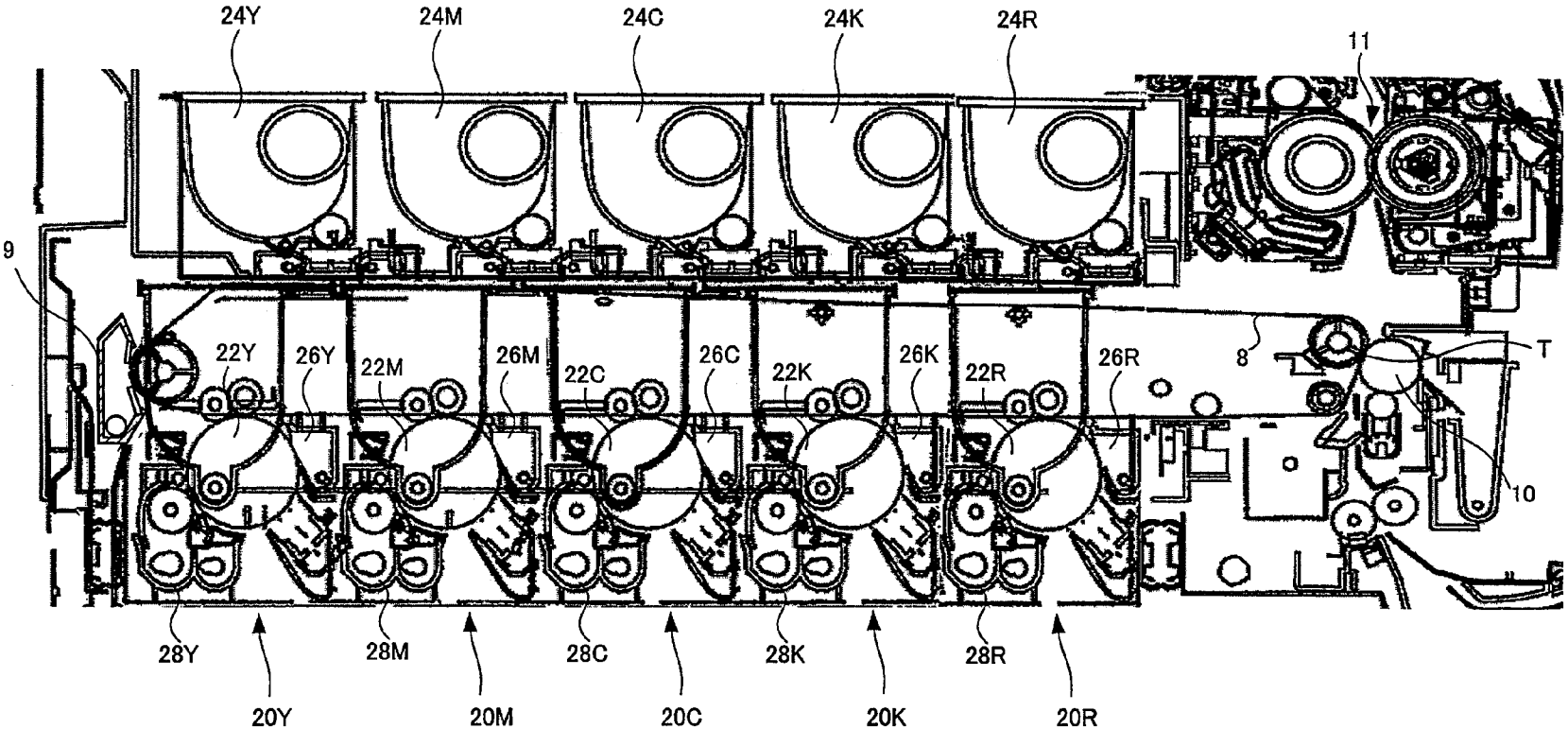
FIG. 2 is an enlarged diagram of a process unit portion of the image forming apparatus.

FIG. 1 is a configuration diagram illustrating a configuration of an image forming apparatus 1 according to this embodiment. FIG. 2 is an enlarged diagram of a process unit portion of the image forming apparatus 1 according to this embodiment.

The image forming apparatus 1 is an MFP (multi-function peripheral) that conducts printing, copying, and scanning. The image forming apparatus 1 includes an image formation unit 1A, a sheet feed unit 1B, an image read unit 1C, a processor 2, a memory 4, an auxiliary storage device 6, and an operation panel 16.

First, the image formation unit 1A forms an image on a sheet in printing or copying. The image formation unit 1A forms the image on the sheet such as a sheet fed from the sheet feed unit 1B on the basis of a print job or a copy job.

The image formation unit 1A includes five process units in total consisting of four process units corresponding to respective toner (developer) of yellow, magenta, cyan, and black, as well as a recycle toner process unit that forms the image with the use of a toner (hereinafter called also "recycle toner") recovered from a photosensitive body of each process unit and an intermediate transfer belt. Specifically, the image formation unit 1A includes a process unit 20Y for yellow, a process unit 20M for magenta, a process unit 20C for cyan, a process unit 20K for black, and a process unit 20R for recycle toner. Further, the image formation unit 1A includes an intermediate transfer belt 8, a transfer belt cleaner 9, a secondary transfer roller 10 as a transfer member, a fixing unit 11, and a discharge tray 12.

In the image forming apparatus 1 according to this embodiment, in image formation in a monochrome mode for forming a monochrome image, a toner image is formed by the process unit 20K for black, and the toner image is transferred onto the intermediate transfer belt 8.

Also, in a color mode for forming a color image, the toner images are formed by the process unit 20Y for yellow, the process unit 20M for magenta, the process unit 20C for cyan, and the process unit 20K for black. The toner images corresponding to the respective colors are superimposed and transferred onto the intermediate transfer belt 8 from the respective process units.

Also, in a recycle mode for forming an image with the recycle toner recovered from the respective process units 20Y to 20R, and the intermediate transfer belt 8, a toner image is formed by the process unit 20R corresponding to the recycle toner, and the toner image is transferred onto the intermediate transfer belt 8. In the recycle mode, because the toner of the respective colors are recovered at one location together, a color of the formed image is changed depending on the circumstances of the past image formation. For that reason, the recycle mode is suitable for a case in which a character can be tentatively read, images may be in any color, and a high-quality image is not required.

The respective process units 20Y to 20R form the toner images of the respective corresponding colors (developer image) on the intermediate transfer belt 8. The respective process units 20Y to 20R include photosensitive bodies 22Y, 22M, 22C, 22K, 22R, toner cartridges 24Y, 24M, 24C, 24K, 24R, cleaners 26Y, 26M, 26C, 26K, 26R, and developing units 28Y, 28M, 28C, 28K, 28R.

Each of the photosensitive bodies 22Y to 22R forms the toner image on a surface thereof, and primarily transfers the toner image onto the intermediate transfer belt 8. The toner image is visualized by forming an electrostatic latent image on the surface by a laser beam with which each of the photosensitive bodies 22Y, 22M, 22C, 22K, and 22R is irradiated, and supplying the toner to each of the photosensitive bodies 22Y, 22M, 22C, 22K, and 22R where the electrostatic latent image is formed.

Each of the toner cartridges 24Y, 24M, 24C, 24K, and 24R stores the toner of each color therein. Also, the toner cartridges 24Y, 24M, 24C, 24K, and 24R supply the toner to the corresponding developing units 28Y, 28M, 28C, 28K, and 28R. Each of the toner cartridges 24Y, 24M, 24C, 24K, and 24R internally includes a paddle and an auger. With rotation of the paddle and the auger by a driving source such as a motor, the toner can be supplied to the developing units 28Y, 28M, 28C, 28K, and 28R.

Also, the toner recovered from the cleaners 26Y, 26M, 26C, 26K, and 26R of the respective process units, and the toner recovered from the transfer belt cleaner 9 are fed to the toner cartridge 24R (recycle developer storage unit) of this embodiment, and stored therein as the recycle toner. The recycle toner stored in the toner cartridge 24R is a toner of color mixture in which the toner of yellow, magenta, cyan, and black are mixed together depending on the usage of the image forming apparatus 1.

Each of the cleaners 26Y, 26M, 26C, 26K, and 26R scrapes off and recovers the toner remaining on each surface of the photosensitive bodies 22Y, 22M, 22C, 22K, and 22R after the toner image is transferred onto the intermediate transfer belt 8 from each of the photosensitive bodies 22Y, 22M, 22C, 22K, and 22R. The toner recovered by the cleaners 26Y, 26M, 26C, 26K, and 26R are supplied to the toner cartridge 24R for storing the recycle toner through a supply mechanism such as the auger.

The developing units 28Y, 28M, 28C, 28K, and 28R supply the toner to the photosensitive bodies 22Y, 22M, 22C, 22K, and 22R, respectively. In this embodiment, the developing unit 28R as the recycle developer developing unit supplies the recycle toner fed from the toner cartridge 24R to the photosensitive body 22R, and visualizes the electrostatic latent image formed on the photosensitive body 22R. The toner images of the respective colors formed on the photosensitive bodies 22Y, 22M, 22C, 22K, and 22R are superimposed and transferred (primarily transferred) onto the intermediate transfer belt 8 from the photosensitive bodies 22Y, 22M, 22C, 22K, and 22R, to form one toner image on the intermediate transfer belt 8. Then, the intermediate transfer belt 8 transfers the formed toner image to the sheet at a secondary transfer position T.

The transfer belt cleaner 9 scrapes off and recovers the toner remaining on the intermediate transfer belt 8 after the toner image is transferred onto the intermediate transfer belt 8 from the photosensitive bodies 22Y, 22M, 22C, 22K, and 22R, and the toner image is transferred onto the sheet at the secondary transfer position T. The toner recovered by the transfer belt cleaner 9 is fed to the toner cartridge 24R for storing the recycle toner therein through a supply mechanism such as the auger.

The secondary transfer roller 10 faces a secondary transfer opposed roller through the intermediate transfer belt 8 at the secondary transfer position T. The secondary transfer roller 10 nips the sheet together with a belt surface of the intermediate transfer belt 8, and transfers the toner image on the intermediate transfer belt 8 to the transported sheet.

The fixing unit 11 thermally fixes the toner image transferred onto the sheet at the secondary transfer position T onto the sheet. The sheet onto which the toner is fixed is discharged to the discharge tray 12.

The outline of the image formation conducted by the image formation unit 1A configured as described above will be described. First, when the image forming apparatus 1 acquires a copy job or a print job, the surfaces of the photosensitive bodies 22Y, 22M, 22C, 22K, and 22R, which are charged by electricity chargers of the respective process units 20Y to 20R, are irradiated with laser beams on the basis of image data of the acquired job to form electrostatic latent images. Then, the developing units 28Y, 28M, 28C, 28K, and 28R supply the toner to photosensitive bodies 22Y, 22M, 22C, 22K, and 22R, on which the electrostatic latent images are formed. With the supply of the toner, the electrostatic latent images formed on the photosensitive bodies 22Y, 22M, 22C, 22K, and 22R are visualized. Then, the photosensitive bodies 22Y, 22M, 22C, 22K, and 22R primarily transfer the toner images onto the intermediate transfer belt 8 at the primary transfer position where the primary transfer roller is arranged.

With the rotation of the intermediate transfer belt 8 and the photosensitive bodies 22Y, 22M, 22C, 22K, and 22R, the toner images of the respective colors are sequentially primarily transferred from the photosensitive bodies 22Y, 22M, 22C, 22K, and 22R to form a toner image corresponding to the image data on the intermediate transfer belt 8. Then, the toner image is secondarily transferred onto the sheet transported from a sheet cassette 14 at the secondary transfer position T.

The sheet on which the toner image is transferred is moved to the fixing unit 11. The fixing unit 11 fixes the toner image onto sheet by heating. The sheet onto which the toner image is fixed is discharged to the discharge tray 12 through a transport path.

The outline of the image formation by the image forming apparatus 1 is described above. The toner images are formed by the corresponding process unit according to each mode of the monochrome mode, the color mode, and the recycle mode as described above.

The sheet feed unit 1B feeds the sheet to the image formation unit 1A. The sheet feed unit 1B includes the sheet cassettes 14, pickup rollers, and transport rollers. FIG. 1 illustrates the image forming apparatus having four sheet cassettes 14 and four pickup rollers.

Each of the sheet cassettes 14 receives sheets such as sheets on which the image is formed. If the image is formed, the pickup roller arranged in each of the sheet cassettes picks up the sheets one by one from the sheet cassettes 14. The picked up sheets are sequentially transported to the secondary transfer position T by a plurality of the transport rollers disposed at a downstream side in the sheet transport direction.

The image read unit 1C is a device for reading the image from an original document when copying or scanning is conducted, which is an image reader provided in a copying machine or an image scanner.

The processor 2 is a processing device that controls various processing in the image formation unit 1A, the sheet feed unit 1B, and the image read unit 1C. The processor 2 executes a program stored in the memory 4 or the auxiliary storage device 6 to execute various functions and execute the processing.

The processor 2 is formed of a CPU (central processing unit), or an MPU (micro processing unit) that can execute the same arithmetic processing as that of the CPU. Also, the processor 2 may be an ASIC (application specific integrated circuit), and the AISC can realize a part or all of the functions provided in the image forming apparatus 1.

The memory 4 is a so-called main storage unit. The memory 4 stores, as the main storage unit, a program allowing the processor 2 to execute processing such as image formation in the image formation unit LA, sheet feeding in the sheet feed unit 1B, and image reading in the image read unit 1C. Also, the memory 4 provides a temporal work area to the processor 2. The memory 4 is, for example, a RAM (random access memory), a ROM (read only memory), a DRAM (dynamic random access memory), an SRAM (static random access memory), a VRAM (video RAM), or a flash memory.

The auxiliary storage device 6 stores various pieces of information in the image forming apparatus 1. The auxiliary storage device 6 may store the above-mentioned program stored in the memory 4 therein. The auxiliary storage device 6 is, for example, a magnetic storage device such as a hard disc drive, an optical storage device, a semiconductor storage device (flash memory, etc.) or the combination of those storage devices.

The operation panel 16 includes a touch panel display unit 16*a* and various operation keys 16*b*. The display unit 16*a* displays instruction items related to print conditions such as a sheet size, the number of copies, print density setting or finish (binding, folding). The operation keys 16*b* include, for example, ten keys, a reset key, a stop key, and a start key. A user can input various processing, or instructions or operation of the items displayed on the display unit 16*a* from the touch panel of the display unit 16*a* or the operation keys 16*b*.

The configuration of the image forming apparatus 1 according to this embodiment is described above.

Figure 3:
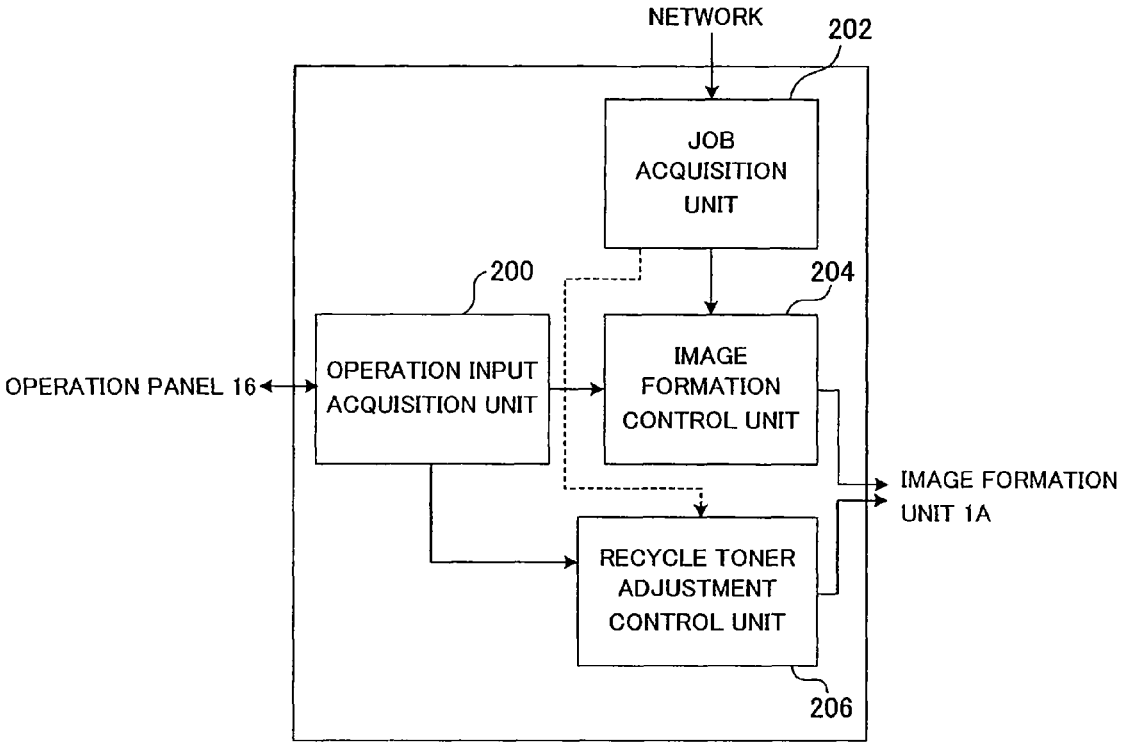
FIG. 3 is a functional block diagram of the image forming apparatus.

Subsequently, the image formation of the image forming apparatus 1 according to this embodiment will be described. FIG. 3 is a functional block diagram of the image forming apparatus 1 according to this embodiment. The functions illustrated in FIG. 3 are realized by execution of an image forming program stored in the memory 4 or the auxiliary storage device 6. Also, if a part or all of the processors 2 are ASICs, the above functions are realized by the ASICs.

The image forming apparatus 1 includes an operation input acquisition unit 200, a job acquisition unit 202, an image formation control unit 204, and a recycle toner adjustment control unit 206.

The operation input acquisition unit 200 acquires an operation input for instructing the image formation such as copying from the operation panel 16.

Further, in this embodiment, the operation input acquisition unit 200 acquires, from the operation panel 16, an instruction of the image formation for designating the image formation in the recycle mode for conducting the image formation by the process unit 20R for the recycle toner.

Also, in this embodiment, the operation input acquisition unit 200 acquires the operation input for instructing execution of the recycle toner adjustment if the image formed on the sheet in the recycle mode is formed by the recycle toner that is only the toner of yellow, or larger in a rate of the yellow toner to make the visibility low.

The recycle toner adjustment is a process of adjusting a hue of the image formed by the recycle toner, particularly a value of the color by changing the ratio of the toner of the respective colors included in the recycle toner stored in the toner cartridge 24R. The details of the recycle toner adjustment will be described in association with the recycle toner adjustment control unit 204.

The job acquisition unit 202 acquires a job for instructing the image formation such as a print job. The job acquisition unit 202 acquires the job from a client computer on a network connected with the image forming apparatus 1.

Also, like the operation input acquisition unit 200, the job acquisition unit 202 can also acquire a job for instructing the execution of the image formation in the recycle mode or a job for instructing the execution of the recycle toner adjustment, on the network.

The image formation control unit 204 allows the image formation unit 1A to execute the image formation on the basis of the operation input for instructing the image formation, which is acquired by the operation input acquisition unit 200.

Also, the image formation control unit 204 allows the image formation unit 1A to execute the image formation on the basis of the job, which is acquired by the job acquisition unit 202. In the monochrome mode, the image formation control unit 204 allows the process unit 20K for black to form the toner image. Also, in the color mode, the image formation control unit 204 allows the process units 20Y, 20M, 20C, and 20K to form the toner image. Also, in the recycle mode, the image formation control unit 204 allows the process unit 20R for the recycle toner to form the toner image.

The recycle toner adjustment control unit 206 executes the recycle toner adjustment on the basis of the instruction for executing the recycle toner adjustment, which is acquired by the operation input acquisition unit 200. Also, even when the job acquisition unit 202 acquires the job for instructing the execution of the recycle toner adjustment, the recycle toner adjustment control unit 206 can execute the recycle toner adjustment as indicated by an arrow of a broken line in FIG. 3.

Now, the details of the recycle toner adjustment will be described.

The toner remaining in the respective photosensitive bodies 22Y to 22K (and the photosensitive body 22R) and the intermediate transfer belt 8 is recovered and stored in the toner cartridge 24R for the recycle toner. For that reason, for example, if the image formation is conducted by mainly using the toner of yellow, the residual toner is also large in the amount of toner of yellow, and the toner of yellow is mainly recovered. As a result, the recycle toner stored in the toner cartridge 24R is high in the content ratio of the toner of yellow. When the content ratio of the toner of yellow is very high, if the image formation is conducted in the recycle mode, a value of the image such as a character becomes high. If the sheet is white, the image is hardly visible.

The recycle toner adjustment is a process for supplying the toner of another color such as black or cyan to the toner cartridge 24R for the recycle toner when the image hardly visible such as a character is formed on the sheet.

More specifically, in this embodiment, if the recycle toner adjustment control unit 206 acquires an instruction for execution of the recycle toner adjustment from the operation input acquisition unit 200 or the job acquisition unit 202, the recycle toner adjustment control unit 206 allows the image formation unit 1A to execute a process of forming the recycle toner adjustment image. The recycle toner adjustment image is, for example, an image (for example, an image having an entire surface of all black) using the toner of black or the like other than yellow.

The recycle toner adjustment control unit 206 conducts a process of spacing the intermediate transfer belt 8 and the secondary transfer roller 10 in the recycle toner adjustment from each other. The reason why the spacing process is conducted is that the toner image formed for the recycle toner adjustment and transferred onto the intermediate transfer belt 8 is moved up to the transfer belt cleaner 9 and is recovered without being transferred to the secondary transfer roller 10, so as to be supplied to the toner cartridge 24R as the recycle toner.

In the process for spacing the intermediate transfer belt 8 and the secondary transfer roller 10 from each other, the secondary transfer roller 10 may be spaced from the intermediate transfer belt 8, or the secondary transfer opposed roller facing the secondary transfer roller 10 may be moved in a direction away from the secondary transfer roller 10 to space the intermediate transfer belt 8 from the secondary transfer roller 10. Also, both of the secondary transfer roller 10 and the intermediate transfer belt 8 may be moved to be spaced from each other.

Also, the recycle toner adjustment control unit 206 controls the driving of the auger provided in the transfer belt cleaner 9, and supplies the toner recovered by the transfer belt cleaner 9 to the toner cartridge 24R of the recycle toner. Also, if the toner image is formed by the recycle toner adjustment, the toner also remains on the surface of the photosensitive body on which the toner image is formed, and the toner is recovered by the cleaner provided in the photosensitive body. Accordingly, the recycle toner adjustment control unit 206 also controls the driving of the auger of the cleaner in the process unit that forms the toner image for the recycle toner adjustment, and supplies the toner recovered in the cleaner to the toner cartridge 24R.

The configuration and functions of the image forming apparatus 1 according to this embodiment are described above.

According to the image forming apparatus 1 of this embodiment, the toner remained on the photosensitive bodies 20Y to 20R and the intermediate transfer belt 8 can be recycled as the recycle toner.

Further, according to the image forming apparatus 1 of this embodiment, the recycle toner adjustment for adjusting the content ratio of the toner of each color contained in the recycle toner is executed whereby a character and an image formed by the recycle toner are more easily visible.

Figure 4:
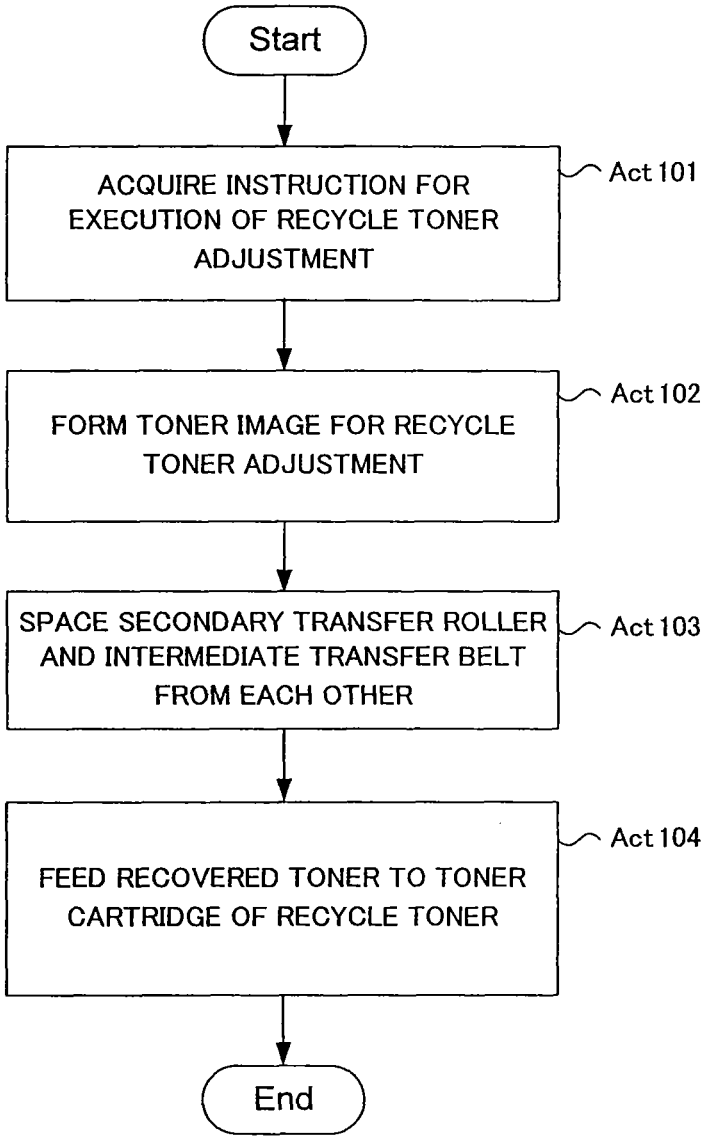
FIG. 4 is a flowchart for describing a flow of a recycle toner adjustment.

Subsequently, a flow of processing in the image forming apparatus 1 according to this embodiment will be described. FIG. 4 is a flowchart for describing a flow of a recycle toner adjustment.

First, if the image formed on a white sheet is yellow in the recycle mode, and a character are hardly visible, the user operates the operation panel 16, and conducts the operation input for instructing the execution of the recycle toner adjustment. The operation input acquisition unit 200 acquires an instruction for execution of the recycle toner adjustment (Act 101).

Then, the recycle toner adjustment control unit 206 allows a given process unit to execute the toner image formation for the recycle toner adjustment on the basis of an instruction acquired by the operation input acquisition unit 200 (Act 102). For example, as described above, if the recycle toner is excess in yellow, and a character printed on the white sheet is hardly readable, the recycle toner adjustment control unit 206 allows the process units 20K and 20C for black and cyan other than yellow to form the toner image for the recycle toner adjustment.

The recycle toner adjustment control unit 206 spaces the secondary transfer roller 10 and the intermediate transfer belt 8 from each other (Act 103). The spacing between those members may be conducted by moving the secondary transfer roller 10, moving the secondary transfer opposed roller facing the secondary transfer roller 10 to move the intermediate transfer belt 8, or moving both of those members as described above.

The recycle toner adjustment control unit 206 controls the driving of the respective augers provided in the transfer belt cleaner 9 and the cleaner of the process unit that forms the toner image for the recycle toner adjustment (for example, the cleaner 26K if the toner image is formed by the process unit 20K for black), and the toner recovered by the cleaner to the toner cartridge 24R of the recycle toner (Act 104).

The flow of the recycle toner adjustment in the image forming apparatus 1 according to this embodiment is described above.

Through the above processing, for example, the toner image is formed in the process unit 20K for black, and the toner of black is recovered by the transfer belt cleaner 9 and the cleaner 26K without being transferred onto the sheet, and then fed to the toner cartridge 24R. With this operation, for example, because the toner of black is added to the recycle toner in which the content ratio of yellow is excess, a color of the toner is thickened. Accordingly, if the image is formed with the recycle toner, a state in which yellow is excess, and the character is hardly readable is eliminated.

The processing in Act 102, Act 103, and Act 104 in the flowchart illustrated in FIG. 4 does not need to be conducted in the stated order. The order of Act 102, Act 103, and Act 104 may be replaced with each other, or those processing may be executed in parallel. That is, if the toner of the toner image formed for the recycle toner adjustment can be recovered by the toner cartridge 24R, any order is acceptable.

If the sheet on which the image is formed is of dark color, the character is more visible when printing is conducted with the toner of yellow. As the ratio of the toner of black or cyan is higher, the character is hardly visible inversely. Accordingly, if the character is easily visible when the value of the toner color is higher, for example, if the sheet color is dark, the toner of yellow may be fed to the toner cartridge 24R by forming the toner image with the use of only the process unit 20Y for yellow in the recycle toner adjustment. That is, the recycle toner adjustment may adjust the toner so that the character is easily visible according to the color of the used sheet.

Also, in this embodiment, in the recycle toner adjustment, the toner image for the recycle toner adjustment is transferred onto the intermediate transfer belt 8, and the toner is recovered by the transfer belt cleaner 9 as described above. However, this embodiment is not limited to this configuration. The toner may be recovered by the cleaners 26Y to 26K provided to the photosensitive body that forms the toner image for the recycle toner adjustment without transferring the toner image to the intermediate transfer belt 8.

Also, in this embodiment, the recycle toner adjustment is executed by an instruction from the operation panel 16 by the user as described above. However, this embodiment is not limited to this configuration. For example, the usage of the toner of each color is predicted on the basis of a use history of the image formation in the color mode or the monochrome mode. If it is determined that the usage of yellow is large, the toner image formation for supplying a given toner such as black or cyan to the toner cartridge 24R is executed. If the recycle toner is adjusted on the basis of the use history of the image formation, the recycle toner making the character easily visible can be arranged.

Second Embodiment

Subsequently, a second embodiment will be described.

The image forming apparatus 1 according to this embodiment further conducts a process for determining whether a character is easily visible in the formed image, or not, when the image is formed by the recycle toner. When the image is formed by the recycle toner, if it is determined that the character is hardly visible, the toner image of a given toner is formed, and the toner is supplied to the toner cartridge 24R as the recycle toner adjustment described in the first embodiment.

Hereinafter, the configuration of the image forming apparatus 1 according to this embodiment will be described. The same configurations as those in the first embodiment are denoted by the same symbols, and their description will be omitted.

Figure 5:
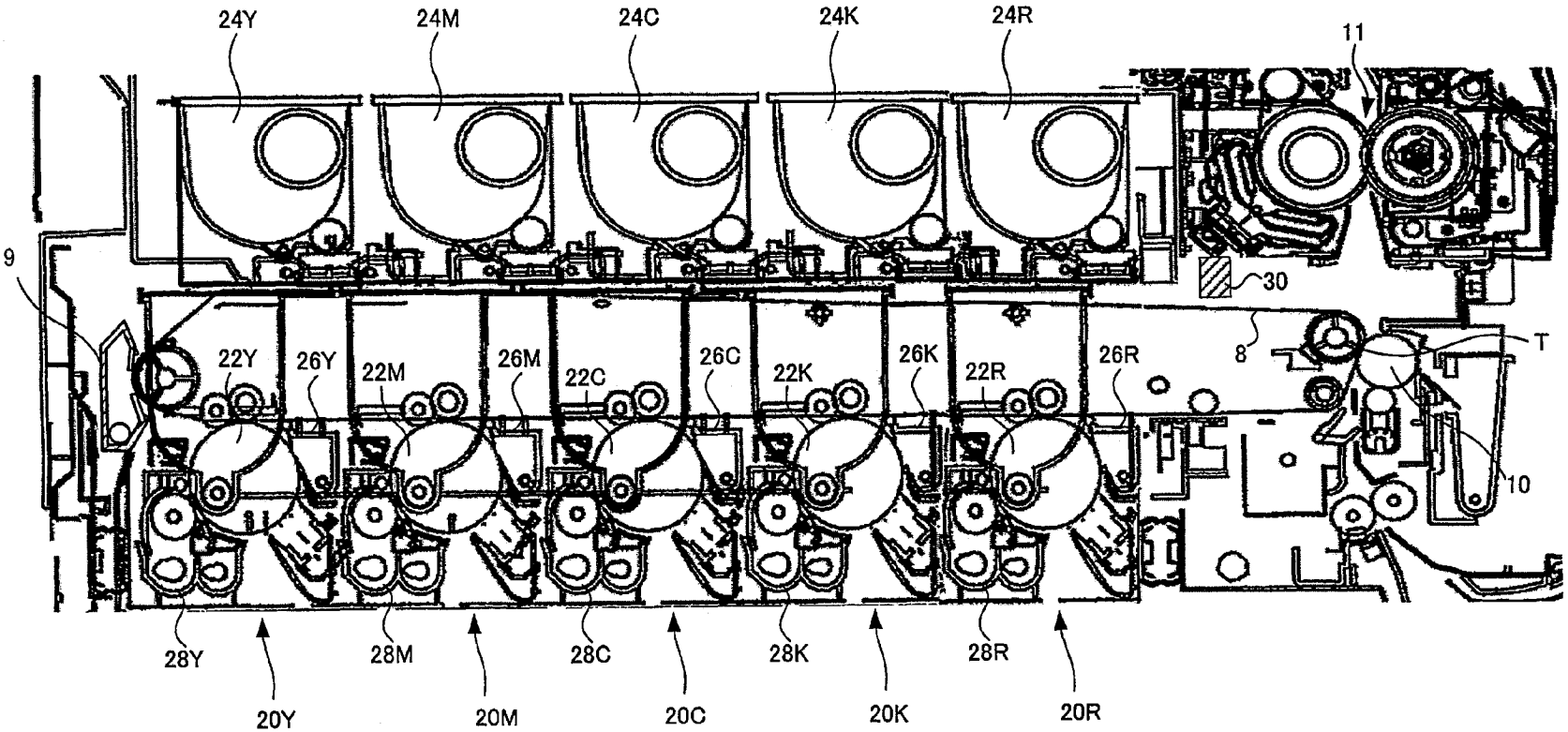
FIG. 5 is an enlarged diagram of a process unit portion of an image forming apparatus according to another embodiment.

FIG. 5 is an enlarged diagram of a process unit portion of the image forming apparatus 1 according to this embodiment.

The image forming apparatus 1 according to this embodiment includes the image formation unit LA, the sheet feed unit 1B, the image read unit 1C, the processor 2, the memory 4, the auxiliary storage device 6, and the operation panel 16 as well as an image sensor 30.

In order to determine whether the character of the image formed by the recycle toner is hardly visible, or not, the image sensor 30 photographs a test chart formed on the photosensitive body 22R by the recycle toner and transferred onto the intermediate transfer belt 8 after a given toner is supplied to the toner cartridge 24R by execution of the toner image formation for the recycle toner adjustment.

The "test chart" in this embodiment is an image for confirming a hue (particularly brightness) of the toner image formed by the process unit 20R of the recycle toner. The test chart may be any image. For example, a test chart stored in the auxiliary storage device 6, which is normally formed as the image and used in order to adjust various members related to the image formation may be used as it is. Also, a dedicated test chart for confirming the hue of the toner image of the recycle toner may be stored in the auxiliary storage device 6 in advance and used.

The test chart is formed on the photosensitive body 22R as the toner image. The toner image of the test chart on the photosensitive body 22R is primarily transferred onto the intermediate transfer belt 8. Then, the secondary transfer roller 10 and the intermediate transfer belt 8 are spaced from each other, and the formed toner image is allowed to pass through the secondary transfer position so as not to be transferred onto the secondary transfer roller 10.

Then, the image sensor 30 takes the toner image on the passing intermediate transfer belt 8 at an imaging position downstream of the secondary transfer position T in the moving direction of the intermediate transfer belt 8. As a result, the image sensor 30 can load the test chart formed by the recycle toner as the image data.

Figure 6:
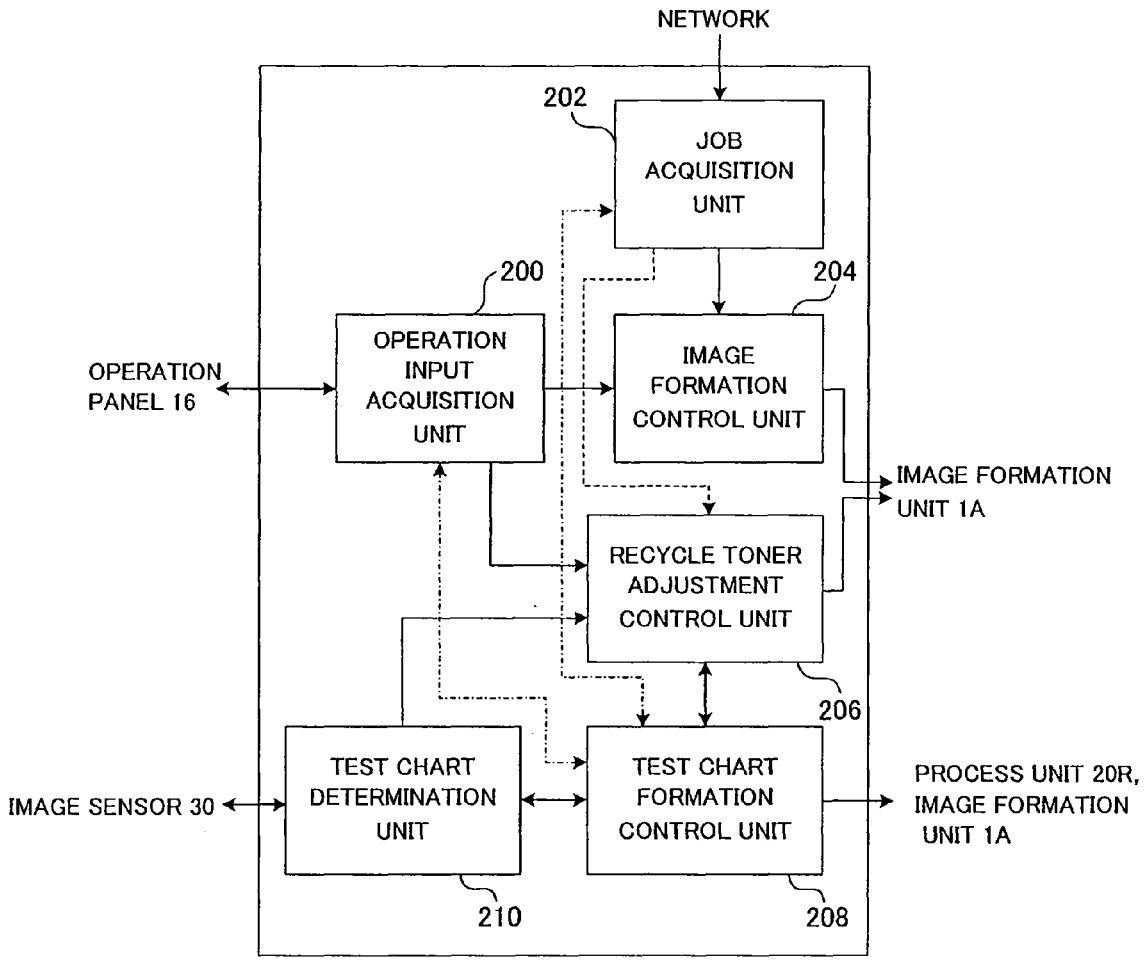
FIG. 6 is a functional block diagram of the image forming apparatus.

Subsequently, the recycle toner adjustment in the image forming apparatus 1 according to this embodiment will be described. FIG. 6 is a functional block diagram of the image forming apparatus 1 according to this embodiment.

As in the first embodiment, the image forming apparatus 1 according to this embodiment includes the operation input acquisition unit 200, the job acquisition unit 202, the image formation control unit 204, and the recycle toner adjustment control unit 206. Further, the image forming apparatus 1 includes a test chart formation control unit 208, and a test chart determination unit 210.

The test chart formation control unit 208 forms the toner image of the test chart on the process unit 20R.

As described above, the test chart formation control unit 208 spaces the secondary transfer roller 10 and the intermediate transfer belt 8 from each other so that the toner image of the test chart transferred onto the intermediate transfer belt 8 is not transferred onto the secondary transfer roller 10 before passing through the imaging position of the image sensor 30.

When the toner image of the test chart is formed by the test chart formation control unit 208, the test chart determination unit 210 allows the image sensor 30 to take the toner image of the test chart transferred onto the intermediate transfer belt 8.

Also, the test chart determination unit 210 determines whether the image of the test chart imaged by the image sensor 30 satisfies a given condition, or not. More specifically, the test chart determination unit 210 calculates a mean value of the values of the entire image according to the image data of the imaged test chart. Then, the test chart determination unit 210 determines whether the mean value of the values exceeds a predetermined reference value, or not.

When the image is formed on the white sheet, if the mean value of the values of the toner image exceeds the reference value, the character is hardly visible in the image formed by the recycle toner. On the other hand, if the mean value of the values is equal to or lower than the referenced value, the character is easily visible in the image formed by the recycle toner.

The above reference value can be appropriately set. For example, if the value is represented by a percentage assuming that the brightest color (white) is 100 and the darkest color (black) is 0, 70% may be set as the reference value. That is, when the toner image of the test chart is taken, and the mean value of the value exceeds 70%, if the image is formed on the white sheet with the use of the recycle toner, it can be determined that the character is hardly visible.

If the image is formed on the dark sheet, contrary to a case in which the image is formed on the white sheet, the character is easily visible when the mean value of the values exceeds the given reference value, and the character is hardly visible when the mean value is equal to or lower than the reference value. In this case, the test chart determination unit 210 may determine that the character is easily visible if the mean value exceeds the reference value (for example, value 70%), and determine that the character is hardly visible if the mean value is equal to or lower than the reference value.

When the test chart determination unit 210 determines that the mean value of the values of the image of the test chart exceeds the reference value, the test chart formation control unit 208 can allow the image formation unit 1A to again execute the formation of the toner image for the recycle toner adjustment so as to supply the given toner to the toner cartridge 24R of the recycle toner.

Figure 7:
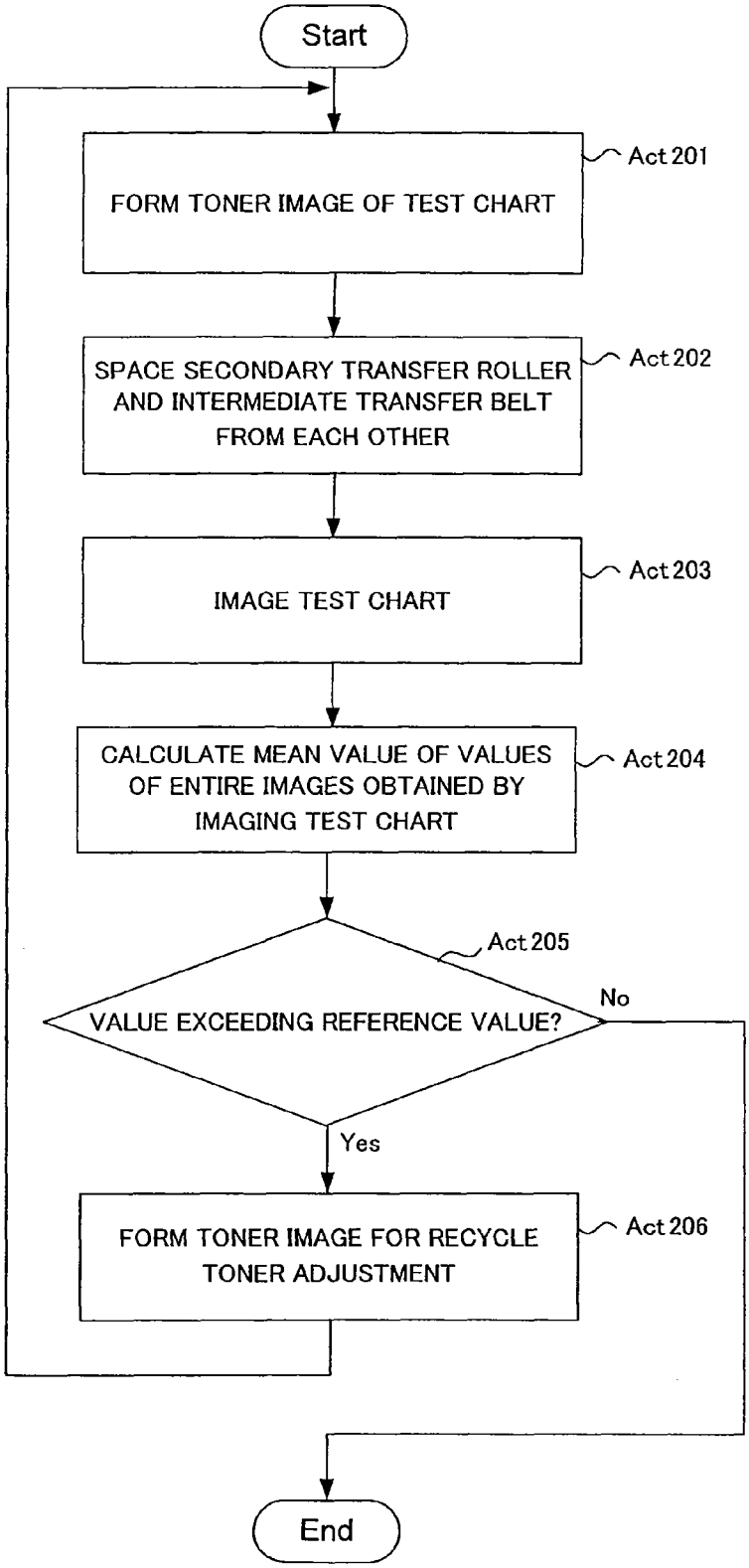
FIG. 7 is a flowchart for describing a flow of a recycle toner adjustment.

Subsequently, a flow of the recycle toner adjustment by the image forming apparatus 1 according to this embodiment will be described. FIG. 7 is a flowchart for describing a flow of a recycle toner adjustment according to this embodiment.

First, the test chart formation control unit 208 allows the process unit 20R to form the toner image of the test chart (Act 201).

Then, the test chart formation control unit 208 controls the image formation unit 1A, and spaces the secondary transfer roller 10 and the intermediate transfer belt 8 from each other so that the toner image of the test chart can pass through the imaging position of the image sensor 30 without being transferred onto the secondary transfer roller 10 (Act 202).

Then, the image sensor 30 takes the toner image of the test chart transferred onto the intermediate transfer belt 8 from the photosensitive body 22R of the process unit 20R (Act 203).

Then, the test chart determination unit 210 loads the image of the test chart taken by the image sensor 30, and calculates the mean value of the values of the entire image of the test chart (Act 204).

Then, the test chart determination unit 210 determines whether the mean value of the values of the entire image exceeds a predetermined reference value, or not (Act 205).

If the mean value exceeds the reference value (yes in Act 205), the recycle toner adjustment control unit 206 forms the toner image for the recycle toner adjustment, and supplies a given toner to the toner cartridge 24R (Act 206). Then, the control returns to Act 201, and repeats the processing once more.

On the other hand, if the mean value does not exceed the reference value (no in Act 205), the recycle toner adjustment is completed.

The flow of the recycle toner adjustment by the image forming apparatus 1 according to this embodiment is described above.

According to this embodiment described above, when the image is formed by the recycle toner, it can be determined whether the image in which the character is hardly visible is formed, or not, on the basis of the value of the image. If it is determined that the character of the image formed by the recycle toner is hardly visible, the given toner can be supplied to the toner cartridge 24R by the process of forming the toner image of the given toner such as black to adjust the hue of the recycle toner.

Therefore, according to the image forming apparatus 1 of this embodiment, the recycle toner can be held in a state of the hue where the image that is easily visible can be formed.

In this embodiment, if the test chart determination unit 210 determines that the value of the image of the test chart exceeds the reference value, the recycle toner adjustment control unit 206 allows the image formation unit 1A to execute the formation of the toner image for the recycle toner adjustment as described above. However, this embodiment is not limited to this configuration. For example, a screen for announcing that the image formed by the recycle toner is hardly visible may be displayed in the display unit 16*a* of the operation panel 16. If an instruction for execution of the recycle toner adjustment is given from a computer of a client connected on the network, the above-mentioned screen may be displayed on a display of the computer of the client.

Also, in this embodiment, as described above, after the test chart is formed, and it is determined whether the value of the image of the test chart taken by the image sensor 30 exceeds the reference value, or not, if the value exceeds the reference value, the toner image for the recycle toner adjustment is formed. However, this embodiment is not limited to this configuration. For example, the toner image for the recycle toner adjustment may be formed before Act 201, and thereafter the process of determining the value of the test chart may be conducted. In this case, it can be determined whether the hue of the recycle toner is adjusted to the degree that the character is easily visible, or not, by formation of the toner image for the recycle toner adjustment, which is conducted in advance.

Further, for example, in FIG. 6, when the operation input or print job for instructing copying in the recycle mode is acquired as indicated by a chain line, before the image formation such as copying or printing is executed, the formation of the test chart and the determination of whether the value of the image of the test chart exceeds the reference value, or not, may be conducted. If the value exceeds the reference value, the recycle toner adjustment control unit 206 may execute the formation of the toner image for the recycle toner adjustment, and adjust the hue of the recycle toner so that the formed image is easily visible. As a result, because the recycle toner is adjusted before the image is formed on the sheet, the wasteful use of the toner can be further suppressed.

Also, in this embodiment, as described above, the toner image of the test chart is taken, and the test chart determination unit 210 determines whether the mean value of the values of the image data exceeds the reference value, or not. However, this embodiment is not limited to this configuration. For example, when a part of the image data exceeds the reference value, it may be determined that yellow of the recycle toner is excess (the image is hardly visible).

Third Embodiment

Subsequently, a third embodiment will be described.

The image forming apparatus 1 according to this embodiment further includes a function of eliminating a state in which the toner of the respective colors is unevenly distributed in the toner cartridge 24R, and the toner is uneven.

Figure 8:
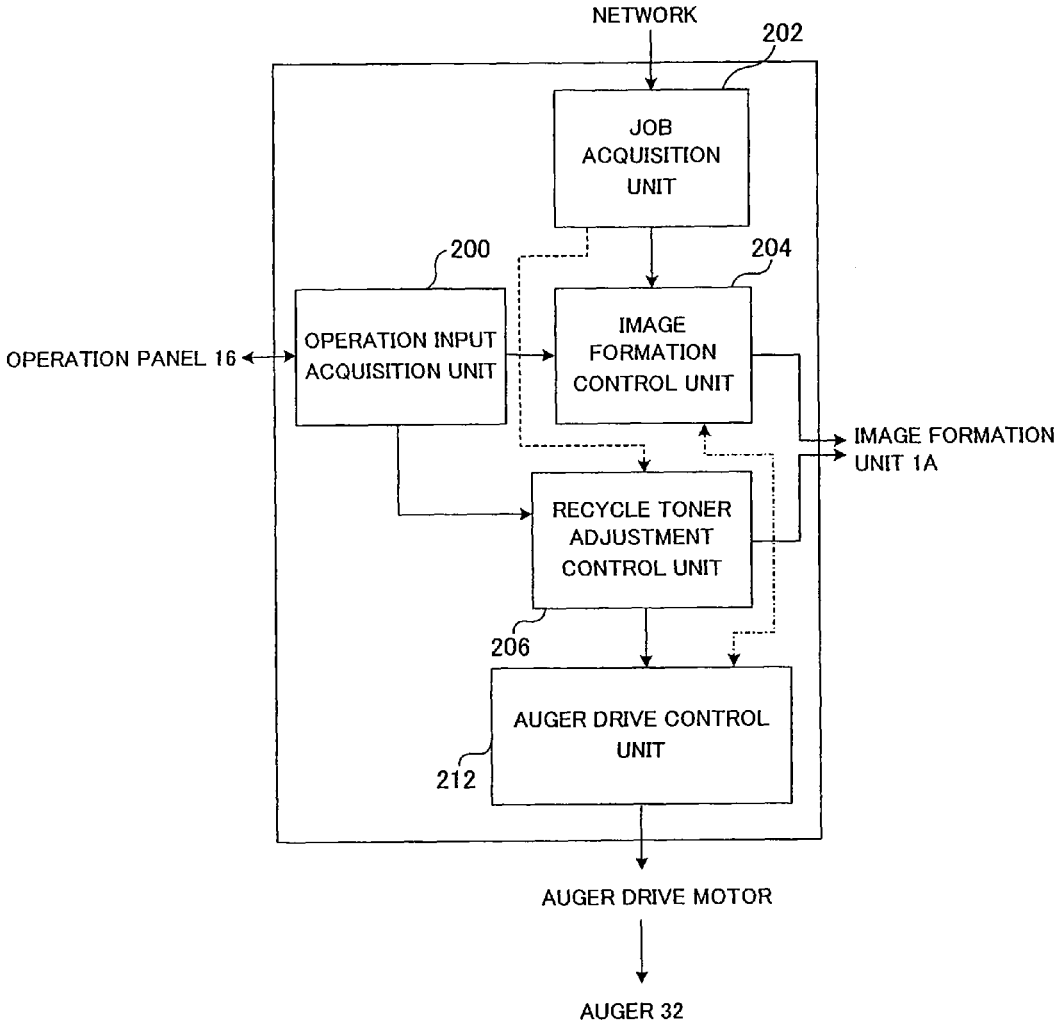
FIG. 8 is a functional block diagram of an image forming apparatus according to still another embodiment.

Hereinafter, a configuration of the image forming apparatus 1 according to this embodiment will be described. FIG. 8 is a functional block diagram of the image forming apparatus 1 according to this embodiment.

As in the first embodiment, the image forming apparatus 1 according to this embodiment includes the operation input acquisition unit 200, the job acquisition unit 202, the image formation control unit 204, and the recycle toner adjustment control unit 206. The image forming apparatus 1 according to this embodiment further includes an auger drive control unit 212.

The auger drive control unit 212 controls the rotary drive of the auger within the toner cartridge 24R.

Figure 9:
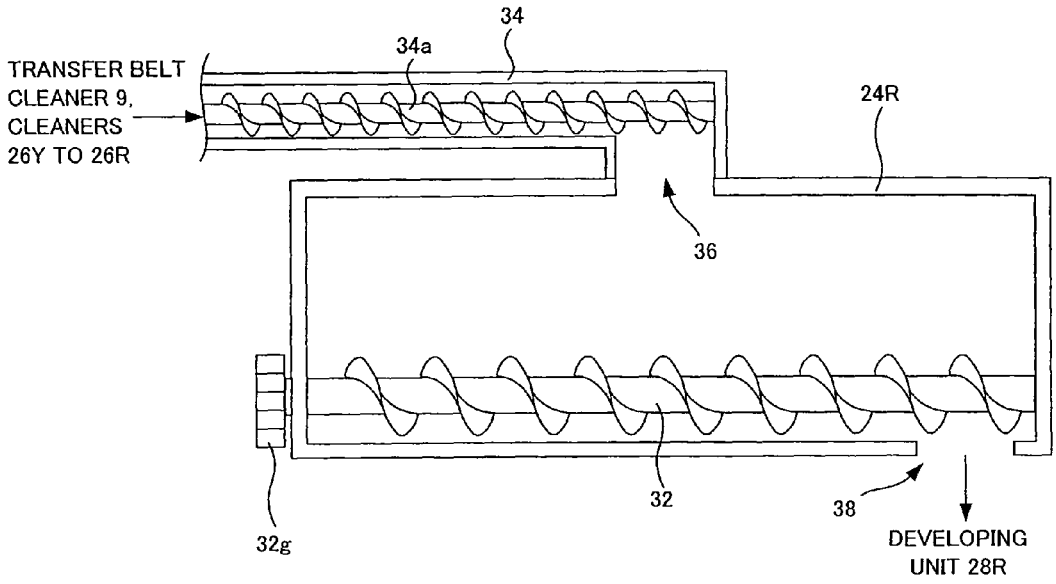
FIG. 9 is a cross-sectional view of a toner cartridge.

A structure of the toner cartridge 24R of the recycle toner will be described. FIG. 9 is a cross-sectional view of the toner cartridge 24R according to this embodiment. The toner cartridge 24R includes an auger 32.

Also, the toner cartridge 24R is formed with an opening portion 36 in a top and an opening portion 38 in a bottom. The opening portion 36 is connected with a toner feed pipe 34, and an auger 34*a* that is a toner feed unit is disposed within the toner feed pipe 34. The toner feed pipe 34 is connected to the transfer belt cleaner 9 and the cleaners 26Y to 26R of the respective process units 20Y to 20R. The toner recovered by the respective cleaners is fed to the toner cartridge 24R by the toner feed unit such as the auger 34*a*, and the fed toner is supplied to the toner cartridge 24R from the opening portion 36.

The toner fed into the toner cartridge 24R is fed to the opening portion 38 side by the auger 32. Then, the toner is supplied to the developing unit 28R connected to the opening portion 38.

The auger 32 is rotated by an auger drive motor connected thereto via a gear. The auger 32 according to this embodiment can rotate in a positive rotation direction for feeding the toner to the opening portion 38 side, and in a negative rotation direction for feeding the toner in a direction far from the opening portion 38 (the gear 32*g* side in FIG. 9).

When the auger 32 positively rotates, the recycle toner is sequentially fed to the developing unit 28R from the opening portion 38. On the other hand, when the auger 32 negatively rotates, the recycle toner is fed to the gear 32*g* side (a direction opposite to the opening portion 38) in FIG. 9. For that reason, because the toner remains without being discharged to the external from the opening portion 38, the toner is agitated by the rotating auger 32. When the toner is agitated, the state in which the toner of the respective colors is unevenly distributed is eliminated.

More specifically, for example, when the toner of black stays at the opening portion 38 side, and the toner of yellow stays at the gear 32*g* side within the toner cartridge 24R, if the auger 32 positively rotates, the toner of black is first supplied to the developing unit 28R, and then the toner of yellow is supplied to the developing unit 28R. With this operation, when the image is formed in the recycle mode, there is a case in which a portion where the image is first formed is black, and a portion where the image is then formed is yellow. In particular, when the image is formed so as to change over from black to yellow on one sheet, the character is hardly readable, or the image is hardly visible.

Thus, when the toner of the respective colors is unevenly distributed within the toner cartridge 24R, the auger negatively rotates so that the toner is agitated before the toner is supplied to the developing unit 28R, and the uneven distribution of the toner is eliminated. As a result, the image quality is stabilized in the recycle mode.

The auger drive control unit 212 controls the auger drive motor, and negatively rotates the auger 32, for example, while the image formation in the recycle mode is not executed, or before the image formation in the recycle mode is executed. As a result, the image formation in the recycle mode can be executed in a state where the uneven distribution of the toner is eliminated.

According to this embodiment described above, under the simple control where the auger 32 of the toner cartridge negatively rotates, a variation of the colors of the recycle toner is eliminated, and the image formation can be more stably conducted in the recycle mode.

Fourth Embodiment

Subsequently, a fourth embodiment will be described. In the image forming apparatus 1 according to this embodiment, the toner cartridge 24R of the recycle toner is fixed by a fixing unit different from that of the other toner cartridges 24Y, 24M, 24C, and 24K.

When any one of the toner cartridges 24Y, 24M, 24C, and 24K are normally empty of the toner, the empty toner cartridge can be extracted from the image forming apparatus 1 in the axial direction of the sheet transport rollers or the secondary transfer roller 10 (on the near side of the paper surface in FIG. 1), and replaced with a fresh one.

On the other hand, because the toner remaining on the photosensitive bodies 22Y to 22K and the intermediate transfer belt 8 is supplied to the toner cartridge 24R of the recycle toner, there is no need to exchange the toner cartridge 24R with a fresh one.

Accordingly, in this embodiment, in order to prevent the toner cartridge 24R from being extracted in error, the toner cartridge 24R is fixed in a method different from that of the toner cartridges 24Y to 24K so as not to be simply extracted.

Figure 10:
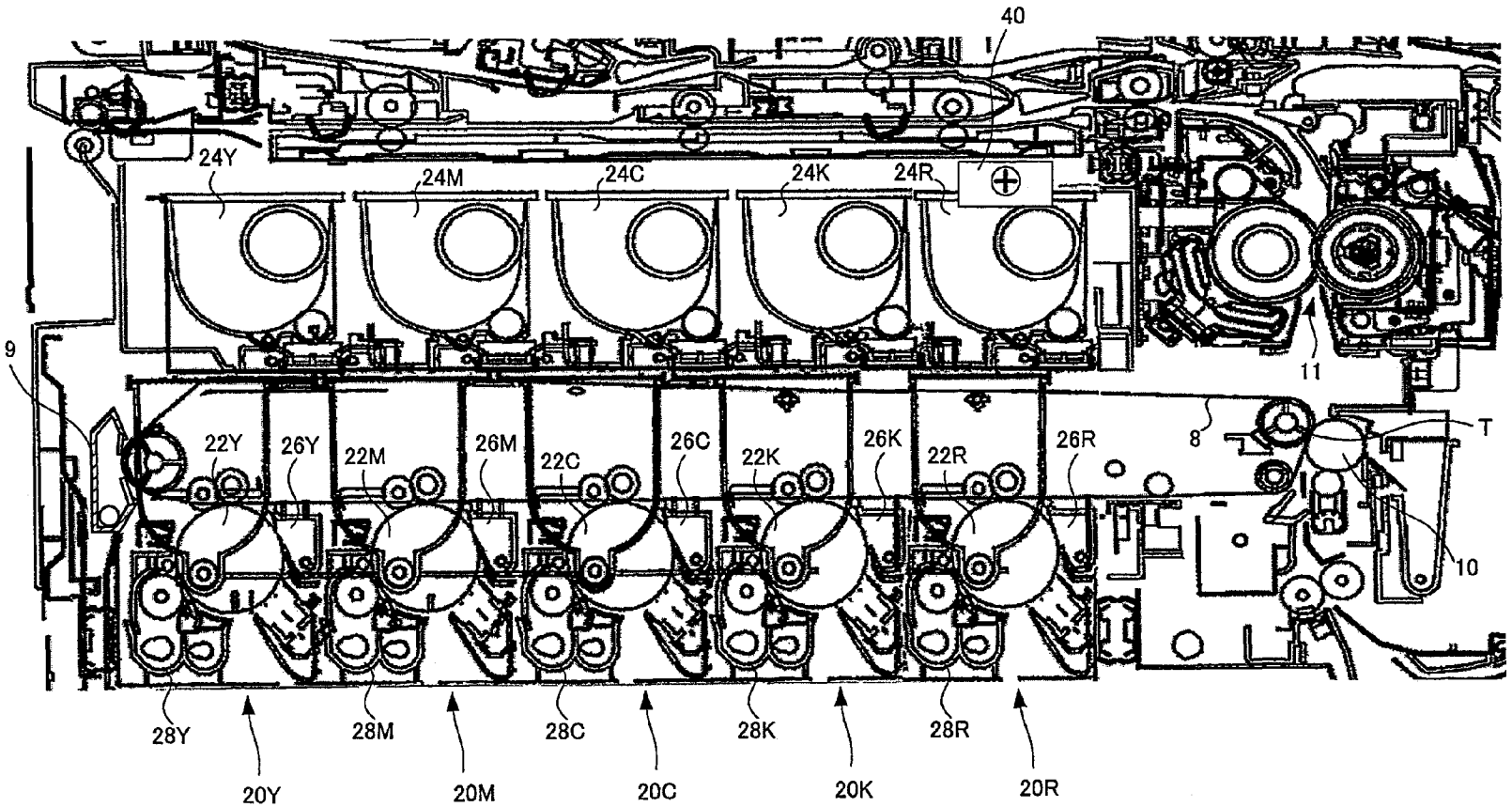
FIG. 10 is an enlarged diagram of a process unit portion in an image forming apparatus according to still another embodiment.

FIG. 10 is an enlarged diagram of a process unit portion in the image forming apparatus 1 according to this embodiment. The image forming apparatus 1 according to this embodiment further includes a fixing member 40 that fixes the toner cartridge 24R in addition to the configuration described in the first embodiment.

The fixing member 40 is a member for fixing the toner cartridge 24R to the image forming apparatus 1 so as not to extract the toner cartridge 24R from the image forming apparatus 1 by a fastening member such as a screw.

In this embodiment, the fixing member 40 is the member for fixing the toner cartridge 24R to the interior of the image forming apparatus 1 by the screw as described above. However, this embodiment is not limited to this configuration. The fixing member 40 can fix the toner cartridge 24R in the method different from that of the toner cartridges 24Y to 24K so as to prevent the toner cartridge 24R of the recycle toner from being extracted by the user in error. For example, a front surface of the toner cartridge 24R of the recycle toner is covered so that the toner cartridge 24R cannot be extracted by simply opening a cover at a front surface of the image forming apparatus 1 by the user.

According to this embodiment described above, because the toner cartridge 24R of the recycle toner is fixed by the fixing unit different from that of the toner cartridges 24Y to 24K, the toner cartridge 24R can be prevented from being extracted in error. On the other hand, if the toner cartridge 24R is not provided integrally within the image forming apparatus 1, a state in which the toner cartridge 24R can be extracted and maintained can be maintained.

Fifth Embodiment

Subsequently, a fifth embodiment will be described. The image forming apparatus 1 according to this embodiment detects the remaining amount of toner in the toner cartridge 24R for the recycle toner, and does not conduct the image formation in the recycle mode if the remaining amount of recycle toner is smaller than the given amount.

Figure 11:
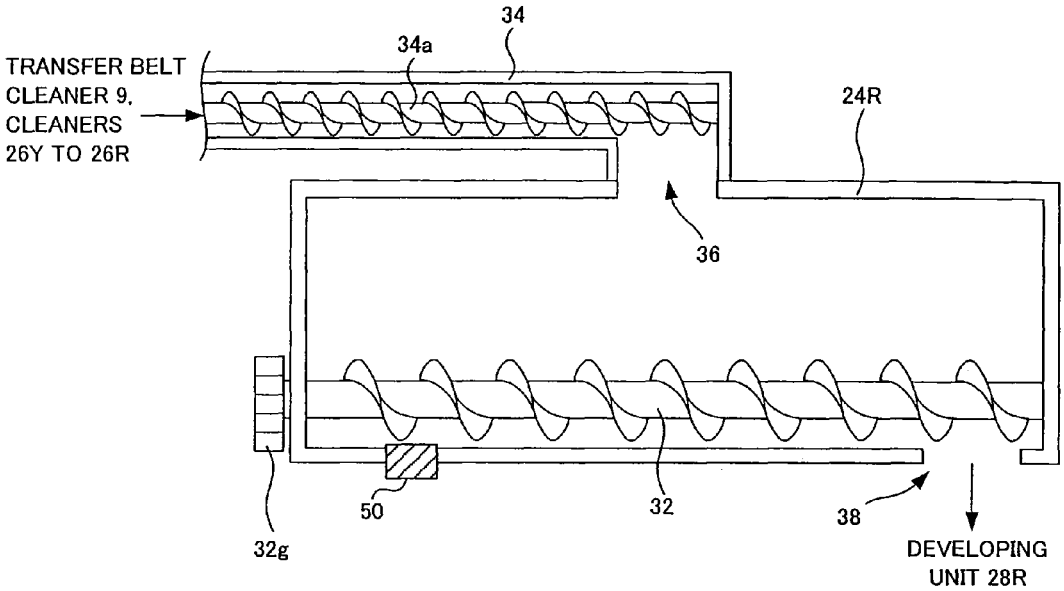
FIG. 11 is a cross-sectional view of a toner cartridge according to still another embodiment.

FIG. 11 is a cross-sectional view of the toner cartridge 24R according to this embodiment.

The toner cartridge 24R according to this embodiment includes a toner remaining amount detection sensor 50. The other configurations are identical with those in FIG. 9, and their description will be omitted.

The toner remaining amount detection sensor 50 detects the remaining amount of recycle toner stored in the toner cartridge 24R. The toner remaining amount detection sensor 50 may be a sensor using a piezoelectric vibrator element such as a piezoelectric element, or an optical sensor.

Subsequently, the remaining amount detection of the toner and a process of limiting the use of the recycle mode based on the remaining amount detection of the toner in the image forming apparatus 1 according to this embodiment will be described.

Figure 12:
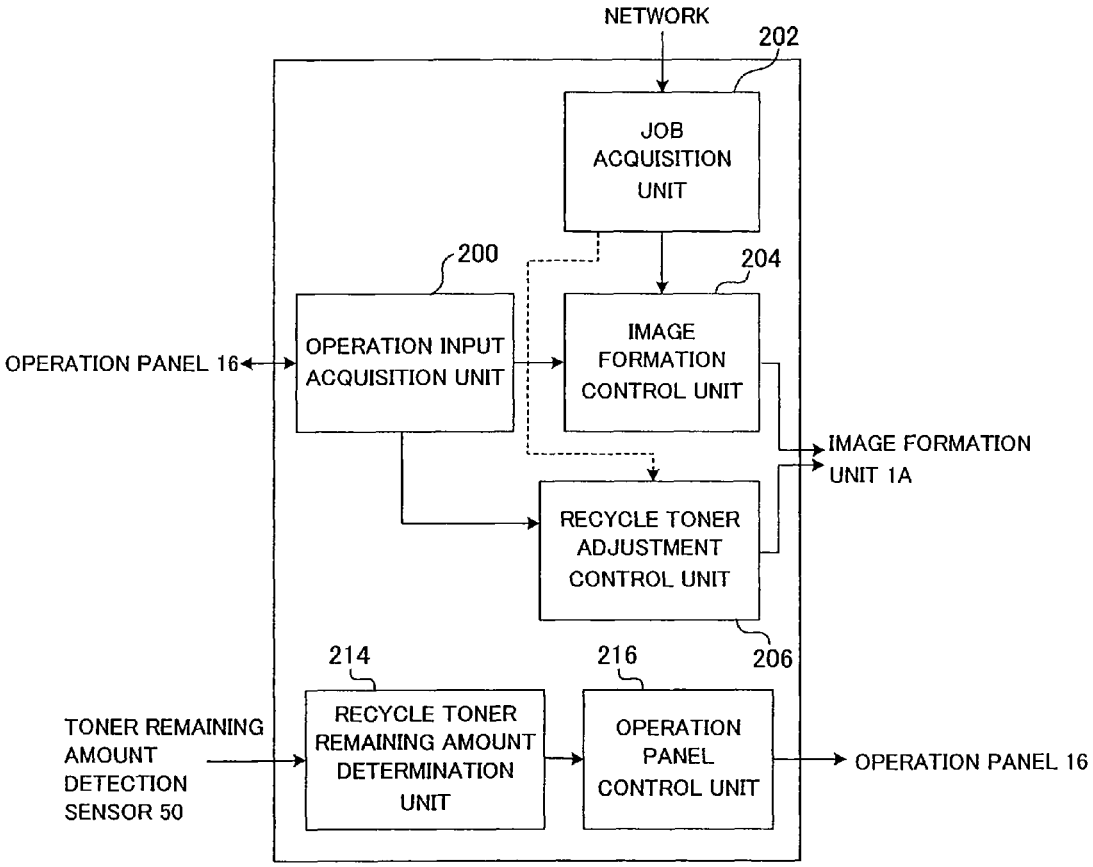
FIG. 12 is a functional block diagram illustrating functions of an image forming apparatus.

FIG. 12 is a functional block diagram illustrating functions of an image forming apparatus 1 according to this embodiment.

The image forming apparatus 1 includes the operation input acquisition unit 200, the job acquisition unit 202, the image formation control unit 204, and the recycle toner adjustment control unit 206. Further, the image forming apparatus 1 according to this embodiment includes a recycle toner remaining amount determination unit 214, and an operation panel control unit 216.

The recycle toner remaining amount determination unit 214 determines whether the recycle toner is equal to or larger than a given amount, or not, on the basis of a detection signal indicative of the remaining amount of recycle toner, which is acquired from the toner remaining amount detection sensor 50. The "given amount" can be appropriately set, but may be set to the amount required for the image formation for 100 sheets or the amount required for the image formation for 500 sheets.

When the recycle toner remaining amount determination unit 214 determines that the remaining amount of recycle toner is smaller than the given amount, the operation panel control unit 216 control the operation panel 16 so as not to receive the operation input for instructing the image formation in the recycle mode. This is because when the recycle toner is smaller than the given amount, the recycle toner may be used up on the way so that the image formation cannot be conducted continuously in the recycle mode.

Also, when the toner is recovered from the photosensitive bodies 22Y to 22R, and the intermediate transfer belt 8, and the recycle toner remaining amount determination unit 214 determines that the recycle toner becomes equal to or larger than the given amount, the operation panel control unit 216 can control the operation panel 16 so as to again receive the image formation in the recycle mode.

Also, when the recycle toner remaining amount determination unit 214 determines that the recycle toner is smaller than the given amount, the operation panel control unit 216 may display a fact that the recycle mode cannot be used on the display unit 16*a* of the operation panel 16.

The function of the image forming apparatus 1 according to this embodiment is described above.

The toner cartridge 24R is not provided with the toner remaining amount detection sensor, but a remaining detection sensor may be provided to a unit such as a sub hopper which stores a given amount of toner from the toner cartridge therein and then supplies the toner to the developing unit.

According to the image forming apparatus 1 of this embodiment describe above, when the recycle toner is sufficiently stored, the image formation in the recycle mode can be conducted.

Figure 13:
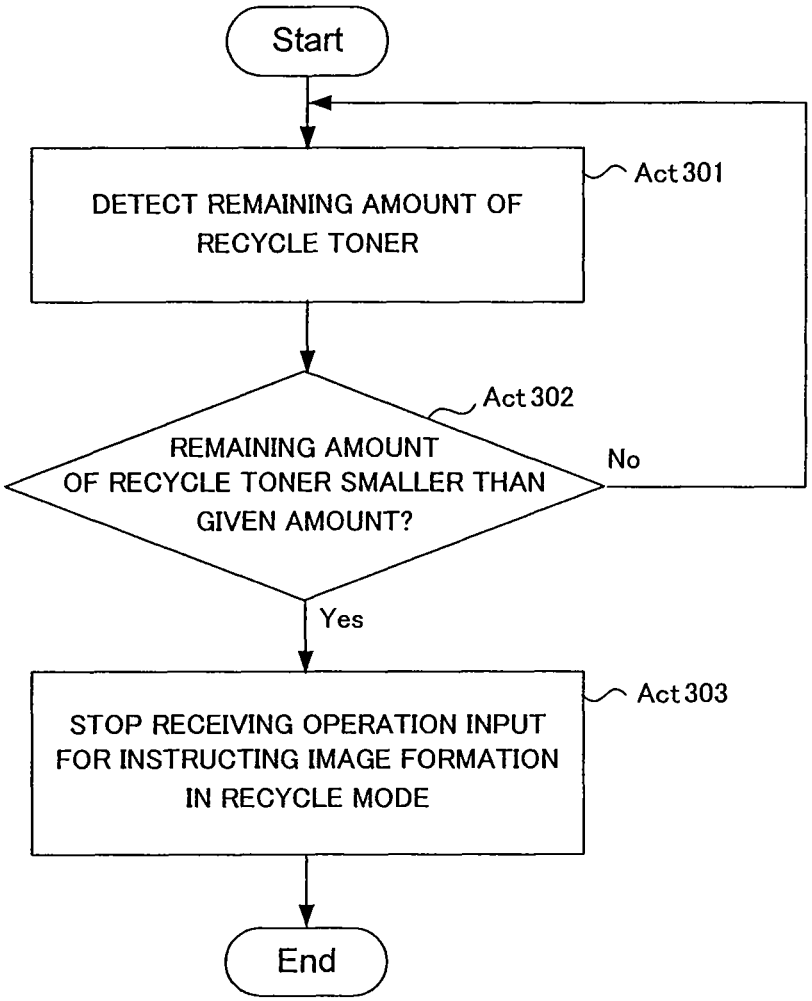
FIG. 13 is a flowchart illustrating a flow of processing for limiting the use of a recycle mode based on remaining amount detection of recycle toner and remaining amount detection of toner.

Subsequently, a description will be given of a flow of processing for limiting the use of the recycle mode on the basis of the remaining amount detection of the recycle toner and the remaining amount detection of the toner according to the image forming apparatus 1 of this embodiment. FIG. 13 is a flowchart illustrating a flow of processing for limiting the use of the recycle mode based on the remaining amount detection of the recycle toner and the remaining amount detection of the toner.

First, the toner remaining amount detection sensor 50 provided in the toner cartridge 24R detects the remaining amount of recycle toner (Act 301).

Then, the recycle toner remaining amount determination unit 214 determines whether the remaining amount of recycle toner detected by the toner remaining amount detection sensor 50 is smaller than a given amount, or not (Act 302).

If it is determined that the remaining amount of recycle toner is small than the given amount (yes in Act 302), the operation panel control unit 216 controls the operation panel 16 so as not to receive the operation input for instructing the image formation in the recycle mode (Act 303). Also, in this situation, the operation panel control unit 216 may display a fact that the remaining amount of recycle toner is short, or a fact that the image formation in the recycle mode cannot be conducted because the remaining amount is short, on the display unit 16*a* of the operation panel 16.

On the other hand, if it is determined that the remaining amount of recycle toner is equal to or larger than the given amount (no in Act 302), the control returns to Act 301, and the process of determining the remaining amount of recycle toner is repeated.

The flow of processing for limiting the use of the recycle mode based on the remaining amount detection of the recycle toner and the remaining amount detection of the toner in the image forming apparatus 1 according to this embodiment is described above.

In this embodiment, if the recycle toner is smaller than the given amount, the operation input for instructing the execution of the image formation in the recycle mode is not received in the operation panel 16 as described above. However, this embodiment is not limited to this configuration. The same processing can be applied to an instruction of the image formation from a client computer connected on the network. That is, the job acquisition unit 202 acquires a job for instructing the print in the recycle mode from the client computer. If the recycle toner is smaller than the given amount, there is provided a function of notifying the client computer of a fact that the remaining amount of recycle toner is short, and the image formation in the recycle mode cannot be conducted (for example, toner remaining amount shortage notifying unit).

As has been described above in detail, according to the above embodiments, there can be provided the image forming apparatus that forms an excellent-quality image with the use of the recycle developer obtained by recovering the developer remaining on the image carrier.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An image forming apparatus, comprising:

an image carrier on which a developer image is formed, and which transfers the formed developer image to a material at a transfer position;

a plurality of developing units each of which supplies a developer of a corresponding color to the image carrier;

a cleaner that is disposed downstream of the transfer position in the rotating direction of the image carrier with respect to the image carrier, removes the developer remaining on the surface of the image carrier, and recovers the removed developer;

a recycle developer storage unit that stores the developer recovered by the cleaner therein;

a recycle developer developing unit that supplies the developer stored in the recycle developer storage unit to the image carrier; and a control unit that controls a recycle developer adjustment by allowing the developer from at least one of the plurality of developing units to be supplied to the image carrier to form a developer image on the image carrier, allowing the developer image to pass through the transfer position without being transferred onto the material, and allowing the developer of the developer image to be recovered by the cleaner into the recycle developer storage unit.

2. The apparatus according to claim 1, further comprising:

a transfer member that faces the transfer position, wherein the control unit spaces at least one of the image carrier and the transfer member from the other to allow the material to pass through the transfer position without transferring the developer image to the material.

3. The apparatus according to claim 1, wherein the image carrier includes a plurality of photosensitive bodies to which the developer is supplied from the plurality of developing units, and an intermediate transfer member that secondarily transfers the developer image, which is primarily transferred from the plurality of photosensitive bodies, onto the material.

4. The apparatus according to claim 1, wherein each of the plurality of developing units supplies the respective developers of yellow, magenta, cyan, and black, and wherein the control unit allows at least one of the developing units corresponding to the developers other than the developer of yellow to supply the corresponding developer to the image carrier.

5. The apparatus according to claim 1, further comprising:

an image sensor that takes the developer image formed on the image carrier as image data;

a test image formation control unit that allows the recycle developer developing unit to supply the developer to the image carrier to form a test developer image on the image carrier by the supplied developer; and a determination unit that determines whether the recycle developer adjustment is to be executed, or not, on the basis of a value of the image data obtained by imaging the test developer image through the image sensor, wherein when the determination unit determines that the recycle developer adjustment is to be executed, the control unit executes the recycle developer adjustment.

6. The apparatus according to claim 5, wherein the determination unit obtains a mean value of the values of the image data, determines whether the mean value exceeds a given reference value, or not, and determines whether the recycle developer adjustment is executed, or not, on the basis of the determination result.

7. The apparatus according to claim 1, wherein the control unit acquires information on usage of the developer image of each color, and determines whether the recycle developer adjustment is executed, or not, on the basis of the information on the usage of the developer.

8. The apparatus according to claim 1, wherein the recycle developer storage unit includes an auger that rotates in one direction to supply the stored developer to the recycle developer developing unit, and wherein the apparatus further comprises an auger drive control unit that allows the auger to rotate in a direction opposite to the one direction to agitate the developer stored in the recycle developer storage unit.

9. The apparatus according to claim 1, further comprising:

a plurality of developer storage units each of which stores the respective developer corresponding to one of the plurality of developing units, and supplies the developer to the corresponding developing unit, wherein the recycle developer storage unit is fixed within the image forming apparatus by a fixing method different from that of the developer storage units.

10. The apparatus according to claim 1, further comprising:

a sensor that detects the remaining amount of developer stored in the recycle developer storage unit; and a developer remaining amount determination unit that determines whether the remaining amount of developer detected by the sensor is smaller than a given amount, or not.

11. An image forming method for an image forming apparatus including: an image carrier on which a developer image is formed thereon, and which transfers the formed developer image to a material at a transfer position; a plurality of developing units each of which supplies a developer of a corresponding color to the image carrier; a cleaner that is disposed downstream of the transfer position in the rotating direction of the image carrier with respect to the image carrier, removes the developer remaining on the surface of the image carrier, and recovers the removed developer; a recycle developer storage unit that stores the developer recovered by the cleaner therein; and a recycle developer developing unit that supplies the developer stored in the recycle developer storage unit to the image carrier, the method comprising:

controlling a recycle developer adjustment by allowing the developer from at least one of the plurality of developing units to be supplied to the image carrier to form a developer image on the image carrier, allowing the developer image to pass through the transfer position without being transferred onto the material, and allowing the developer of the developer image to be recovered by the cleaner into the recycle developer storage unit.

12. The method according to claim 11, wherein the image forming apparatus further includes a transfer member that faces the transfer position, wherein at least one of the image carrier and the transfer member is spaced from the other to allow the material to pass through the transfer position without transferring the developer image to the material.

13. The method according to claim 11, wherein the image carrier includes a plurality of photosensitive bodies to which the developer is supplied from the plurality of developing units, and an intermediate transfer member that secondarily transfers the developer image, which is primarily transferred from the plurality of photosensitive bodies, onto the material.

14. The method according to claim 11, wherein each of the plurality of developing units supply the respective developers of yellow, magenta, cyan, and black, and wherein at least one of the developing units corresponding to the developers other than the developer of yellow is allowed to supply the corresponding developer to the image carrier.

15. The method according to claim 11, wherein the image forming apparatus further includes an image sensor that takes the developer image formed on the image carrier as image data, wherein the recycle developer developing unit is allowed to supply the developer to the image carrier to form a test developer image on the image carrier by the supplied developer, wherein whether the recycle developer adjustment is to be executed, or not, is determined on the basis of a value of the image data obtained by imaging the test developer image through the image sensor, wherein when determination that the recycle developer adjustment is to be executed is made, the recycle developer adjustment is executed.

16. The method according to claim 15, wherein a mean value of the values of the image data is obtained, whether the mean value exceeds a given reference value, or not, is determined, and whether the recycle developer adjustment is executed, or not, is determined on the basis of the determination result.

17. The method according to claim 11, wherein information on usage of the developer image of each color is acquired, and whether the recycle developer adjustment is executed, or not, is determined on the basis of the information on the usage of the developer.

18. The method according to claim 11, wherein the recycle developer storage unit includes an auger that rotates in one direction to supply the stored developer to the recycle developer developing unit, and wherein the auger is allowed to rotate in a direction opposite to the one direction to agitate the developer stored in the recycle developer storage unit.

19. The method according to claim 11, wherein the image forming apparatus further includes a plurality of developer storage units each of which stores the respective developer corresponding to one of the plurality of developing units, and supplies the developer to the corresponding developing unit, wherein the recycle developer storage unit is fixed within the image forming apparatus by a fixing method different from that of the developer storage units.

20. The method according to claim 11, wherein the image forming apparatus further includes: a sensor that detects the remaining amount of developer stored in the recycle developer storage unit; and a developer remaining amount determination unit that determines whether the remaining amount of developer detected by the sensor is smaller than a given amount, or not.

* * * * *